US005318051A

United States Patent [19]

Koppel

[11] Patent Number: 5,318,051

[45] Date of Patent: Jun. 7, 1994

[54] COMB STRUCTURE AND METHOD OF MAKING THE SAME

[75] Inventor: Bernie Koppel, Plantation, Fla.

[73] Assignee: Sunbelt Precision Products, Inc., Fort Lauderdale, Fla.

[21] Appl. No.: 822,418

[22] Filed: Jan. 17, 1992

[51] Int. Cl.[5] ..... A45D 24/04

[52] U.S. Cl. ..... 132/126; 132/137; 132/138; 132/142; 132/219

[58] Field of Search ..... 132/117, 126, 137, 138, 132/142, 155, 219

[56] References Cited

U.S. PATENT DOCUMENTS

| | | | |
|---|---|---|---|
| Re. 22,035 | 2/1942 | Huppert | 132/137 |
| 466,496 | 1/1892 | Heysinger | 132/138 |
| 894,674 | 7/1908 | Lofstrom | 132/138 |
| 928,785 | 7/1909 | McLean . | |
| 1,094,013 | 4/1914 | Peterson | 132/137 |
| 1,780,206 | 11/1930 | McKellar | 132/137 |
| 2,562,465 | 7/1951 | Kassel | 132/138 |
| 2,598,330 | 5/1952 | Wilson | 132/142 |
| 2,599,115 | 6/1952 | Lovegrove | 132/138 |
| 3,665,937 | 5/1972 | Nakagawa . | |
| 4,671,303 | 6/1987 | Saferstein . | |
| 5,072,746 | 12/1991 | Kantor | 132/219 |

FOREIGN PATENT DOCUMENTS

| | | | |
|---|---|---|---|
| 83769 | 4/1921 | Austria | 132/138 |
| 764468 | 5/1934 | France | 132/142 |
| 957635 | 2/1950 | France | 132/142 |

*Primary Examiner*—Gene Mancene
*Assistant Examiner*—Frank A. LaViola
*Attorney, Agent, or Firm*—Darby & Darby

[57] ABSTRACT

A comb is formed from two half-comb sections laid one on top of the other. Each half of the comb includes every other tooth of the full comb, such that when the two halves are mated, the two sets of teeth will be interleaved to form a comb having narrow inter-tooth gaps. This allows each of the half-comb blanks to be directly stamped from a sheet material. Where it is desired to electrically insulate adjacent teeth from one another, a non-conductive separator is interposed between the two half-comb sections during assembly.

12 Claims, 8 Drawing Sheets

COMB STRUCTURE AND METHOD OF MAKING THE SAME

FIELD OF THE INVENTION

This invention relates generally to comb structures. More specifically, this invention relates to a fine tooth comb having narrow gaps between the teeth and a method of making the comb.

BACKGROUND OF THE INVENTION

When forming a conventional comb, such as those used in normal grooming of human hair, it is conventional to mold the entire comb in a single piece from some relatively hard material such as plastic or metal. With sizable gaps between teeth of a conventional comb, it is possible to use a conventional mold for the entire comb and quickly and efficiently mass-produce them.

However, certain specialty combs have structural and manufacturing requirements that make it impossible to use a conventional molding procedure for manufacture. One type of these specialty combs is the fine tooth comb used in the removal of lice from hair. The head louse is an external parasite known to occasionally infest the hair of a mammal, including humans. Removal of adult lice from hair can be a routine procedure requiring perhaps only a washing of the infested hair with special shampoo. However, these parasites glue their eggs, or "nits," directly to individual shafts of hair, making their removal more difficult. It is important that the lice and nits be removed as soon as possible once an infestation is discovered. In addition to the uncomfortable itching caused by bites of the lice, they may transmit pathogens that cause various infectious diseases, such as typhus. It is also important that all the nits be removed, as one remaining nit can begin a new infestation.

The most common method of removing nits from hair is to use a fine tooth comb having gaps between its teeth approximating the average thickness of a human hair. Thus, as the comb is run through the hair, the teeth will straddle the hair shafts and physically remove the nits from each individual strand.

Unfortunately, since the gaps between the teeth of such combs should be on the order of 0.004 to 0.01 inch, it becomes impractical to create a mold that can form these teeth in a quick or efficient process. Alternatively, machining a comb to this specification requires highly accurate equipment. One known alternate method of forming fine tooth combs is to use a multilaminate structure, such as that disclosed in U.S. Pat. No. 4,671,303. In this method, each tooth is stamped individually, integral with a corresponding body portion. A plurality of these tooth/body laminates are then stacked side by side and connected with a connecting rod or stake running through the body portions. While this method can produce a comb with extremely narrow inter-tooth gaps, it involves a large number of production steps and assembly parts, as well as complicated machinery to stamp, stack and connect the teeth.

It is known in the art of louse and nit removal that electric fields or the application of electric current near or through the nits can aid in the demise and removal of lice and nits. It is also known that the electric energy can be applied through a comb by having adjacent teeth electrically insulated from each other and connected to opposite electric poles. However, the conventional molded or stacked laminate version of a fine tooth comb does not lend itself easily to electrification, as either the entire comb or all of the adjacent laminates are formed of metal and thus are electrically connected.

It is thus an object of the invention to provide a comb structure having a minimum of assembly parts and a method for manufacturing the comb having a minimum of assembly steps.

It is a further object of the invention that the comb be easily adapted to accommodate electrical connection.

It is another object of the invention that the comb be simple and cost effective to manufacture.

SUMMARY OF THE INVENTION

In accordance with the objects of the invention, a comb is formed from two half-comb blanks or layers laid one on top of the other. Each half of the comb includes every other tooth of the full comb, such that when the two halves are mated, the two sets of teeth will be interleaved to form a comb having narrow inter-tooth gaps. This allows each of the half-comb blanks to be directly stamped from a sheet material as a practical matter, since the spacing between the teeth of the half-comb is much greater than the inter-tooth gaps of the completed comb. Where it is desired to electrically insulate adjacent teeth from one another, a non-conductive separator is interposed between the two half-comb blanks during assembly.

BRIEF DESCRIPTION OF THE DRAWINGS

The foregoing and other objects and advantages will become apparent to those skilled in the art upon reading the following detailed description in conjunction with a review of the appended drawings, in which.

DETAILED DESCRIPTION OF THE PREFERRED EMBODIMENTS

Figure 1:
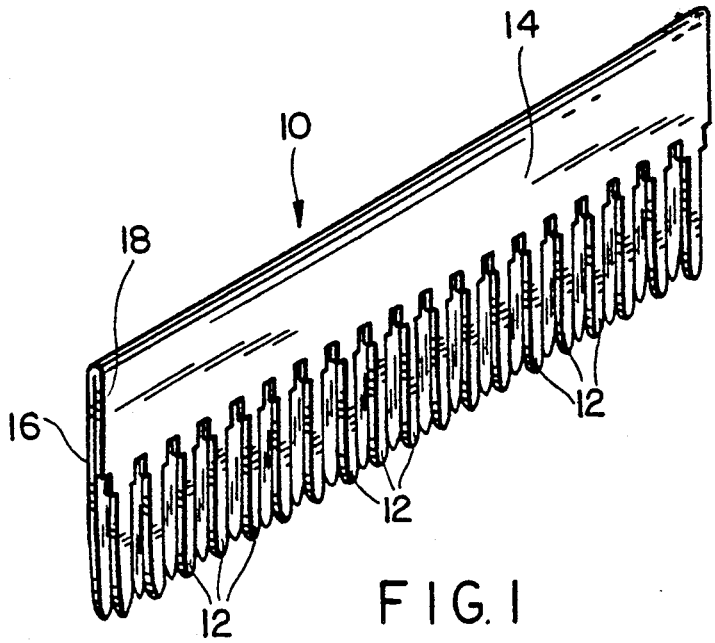
FIG. 1 is a perspective view of a comb according to the invention.

Referring now to the drawings, FIG. 1 shows a perspective view of a comb 10 according to a preferred embodiment of the invention. The comb 10 comprises a plurality of teeth 12 extending from a body portion 14. It will be seen in the figure that the body portion 14 is preferably comprised of two overlying layers 16,18 of material, with the teeth 12 alternately attached to each of the layers 16,18. No two adjacent teeth 12 are attached to the same layer of the body portion 14. Preferably, the comb 10 is formed of a relatively rigid material such as steel or, as will be seen with an embodiment described below, other conductive metal such as beryllium copper or phosphor bronze.

Figure 2:
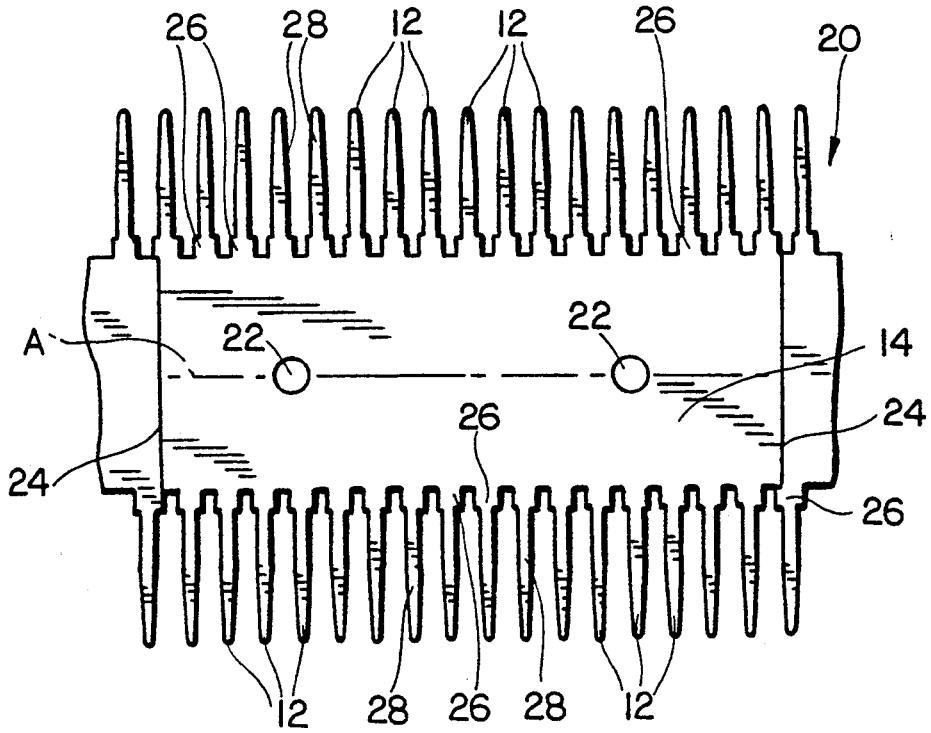
FIG. 2 is a plan view of a blank used to form a comb as in FIG. 1.
Figure 3:
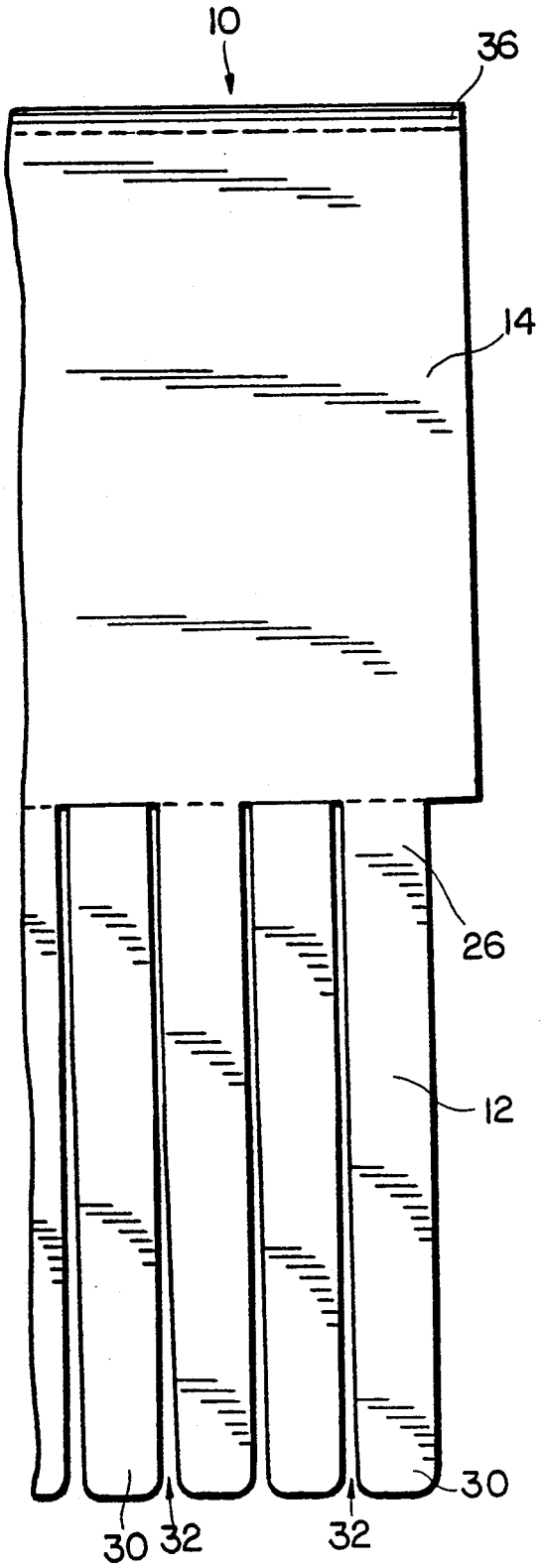
FIG. 3 is a partial plan view of a comb according to FIG. 1.

A blank 20 used to form a comb 10 as in FIG. 1 is shown in FIG. 2. In this embodiment, the entire comb 10 is formed from a single piece of metal stamped from a strip of stock material. The central body portion 14 is stamped with indexing holes 22 to be used for moving the strip stock through a manufacturing device, such as a progressive stamping machine. A set of uniformly spaced teeth 12 extends from each lateral edge of the body portion 14. The sets of teeth have the same pitch, and one set is offset from the set on the opposite side by one half that pitch, so that when the blank 20 is folded along the median line A, the teeth 12 will interleave to become adjacent teeth 12 with narrow inter-tooth gaps 32, as shown in FIG. 3. Preferably before folding, the blank 20 is cut from the strip stock at appropriate cutlines 24. As will be seen, the spacing between two adjacent teeth 12 of each set is equal to the width of the intervening tooth 12 from the other set, plus twice the inter-tooth gap 32 between adjacent teeth in the final formed comb. This permits the inter-tooth spacing of each set to be substantially larger than the inter-tooth gap 32 in the final comb, making it practicable to form the blank by available progressive stamping equipment.

In this embodiment, each tooth 12 is formed with a straight section 26 and a tapered section 28 that tapers towards the distal end 30 of the tooth 12, causing the inter-tooth gap 32 to be increased at the distal end 30. This taper allows individual strands of hair to more easily enter the inter-tooth gap 32 during combing. Preferably, the gap 32 at the proximal end 34 of the teeth 12 will be approximately 0.004 to 0.005 inch while the gap 32 at the distal end 30 of the teeth 12 will be approximately 0.01 inch. While such spacings are very difficult to attain by conventional practice of directly stamping a blank, by contrast, the inter-tooth spacing of the blank in FIG. 2 may be on the order of 0.07 inch. The angle of the taper from the proximal end of the tapered section 28 to the distal end 30 of the tooth 12 may be within the range of degree to three degrees and is preferably 1 degree and 8 minutes.

Figure 4:
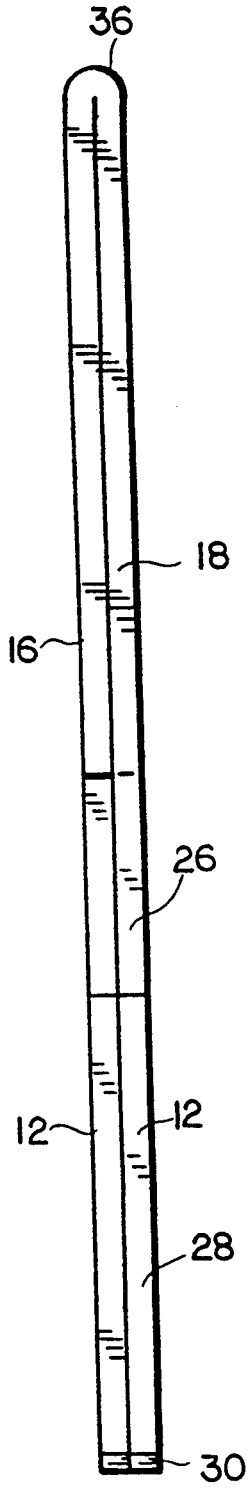
FIG. 4 is a side view of the comb in FIG. 1.

FIG. 4 shows a side view of the comb 10 shown in FIGS. 1 and 3. The two overlaying layers 16,18 of the body portion 14 can be seen in FIG. 4 as well as the fold 36 at the median of the body portion 14. It can also be seen that the thickness of the material used to form the comb 10 is preferably a small fraction of the width of the comb 10, preferably approximately 0.15 inches thick. It can also be seen that in this embodiment adjacent teeth 12 are not in the same plane along the length of the comb 10, but are rather staggered, such that each tooth remains in the plane of its respective body portion layer 16,18. However, with thin material for the comb, the staggered tooth arrangement does not impair the comb's usefulness.

Figure 5:
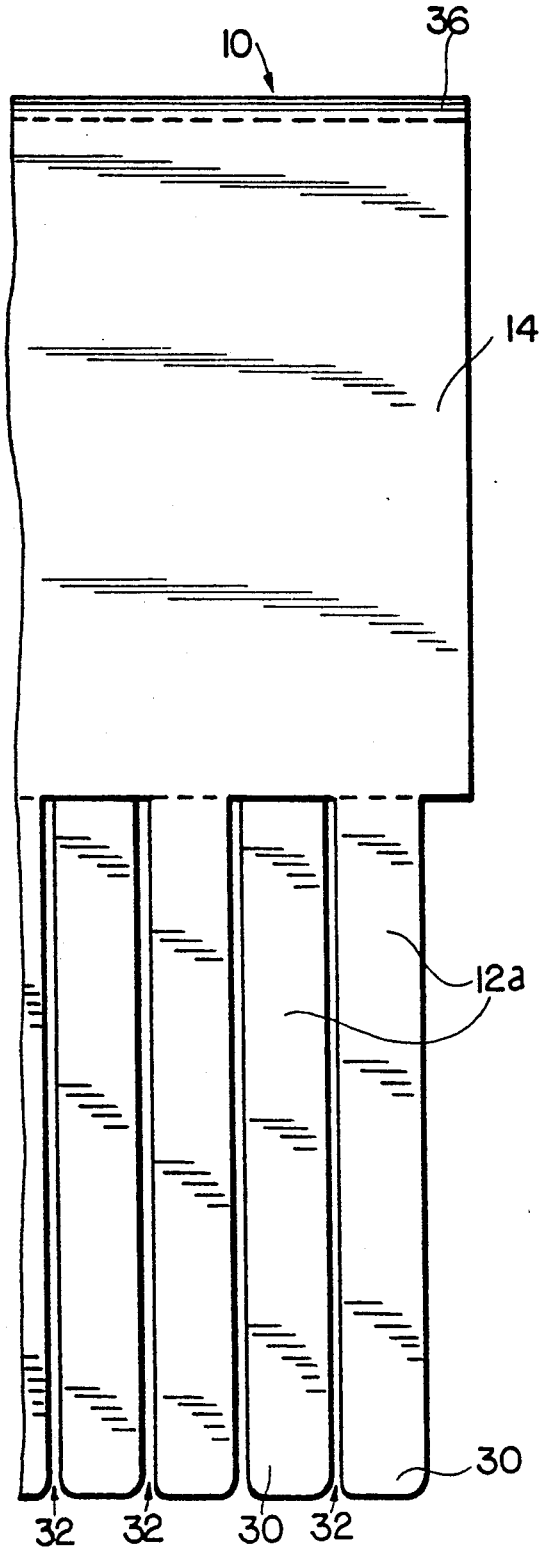
FIG. 5 is a partial plan view of a comb according to the invention having straight teeth.

The embodiment of FIG. 5 illustrates that other tooth shapes are contemplated by this invention including the straight, non-tapered teeth 12*a* shown in this figure. A general requirement for the shape of the teeth 12 and the inter-tooth gap 32 is that it be possible for known human hair diameters to enter the inter-tooth gap 32 and be closely embraced by the teeth 12 such that the teeth 12 may scrape off any nits attached to the hair shafts.

Figure 6:
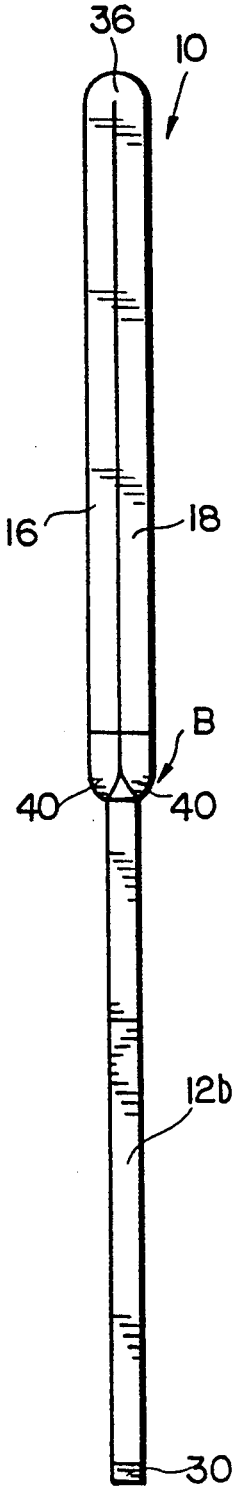
FIG. 6 is a side view of a comb according to an alternate embodiment of the invention.

FIG. 6 shows a side view of an alternate embodiment of the comb 10 of the present invention. The comb 10 is generally similar to that shown in FIGS. 3 and 4, except that the teeth 12*b* have a slight offset 40 in them at the position marked at B. As each tooth extends from its respective body portion layer 16,18, it is bent slightly in S fashion so that the center line of the teeth 12*b* will lie along the center line of the folded body portion 14. Thus, all of the teeth 12*b* will lie in the same plane, which may make it easier for moving the comb 10 through the hair. The tooth S-bend 40 of this embodiment can be formed either before or after the blank 20 used to form the comb 10 is folded along its median line A.

Figure 7:
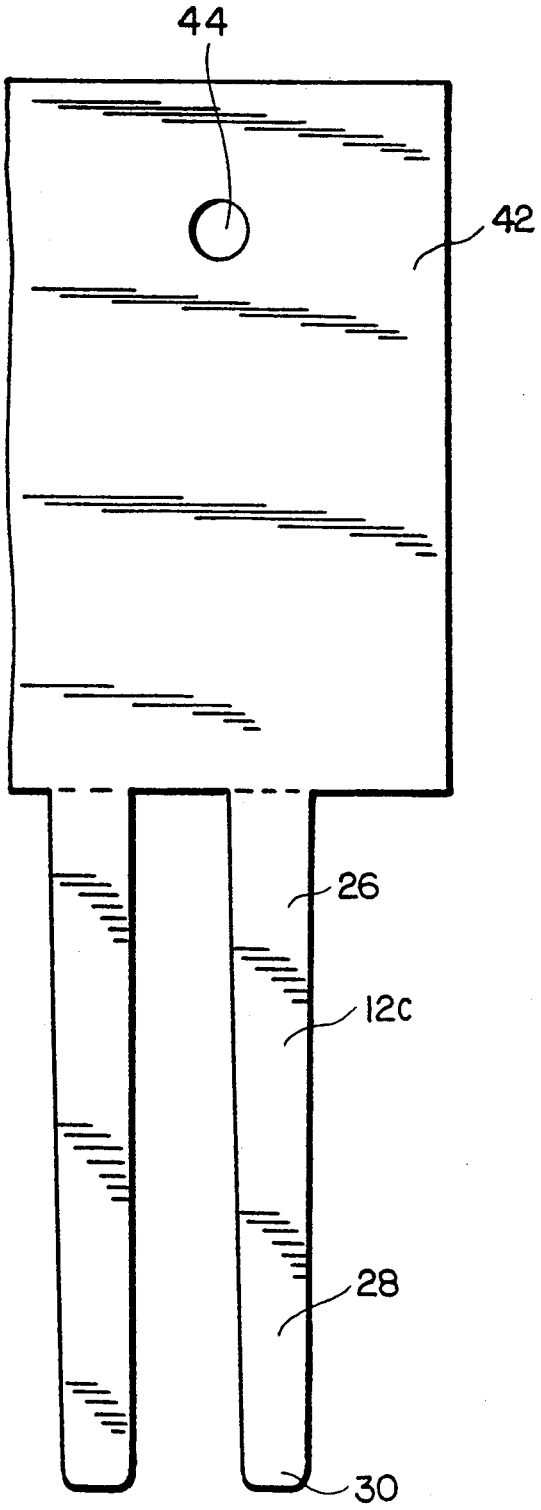
FIG. 7 is a partial plan view of a half-comb blank used to form a comb according to another alternate embodiment of the invention.

In FIG. 7, a partial plan view of another alternate embodiment of the comb 10 is shown, in which the two halves of the comb 10 are stamped as separate blanks 42. A portion of one of the blanks 42 is shown in plan view in FIG. 7. This blank 42 can be stamped by cutting the blank 20 of FIG. 2 along the median line A. Alternatively, the blanks 42 could be stamped consecutively from a narrower strip of stock material. The stamping machinery would then only need to stamp the teeth 12*c* into the blank 42 on one lateral edge of the stock material.

Figure 8:
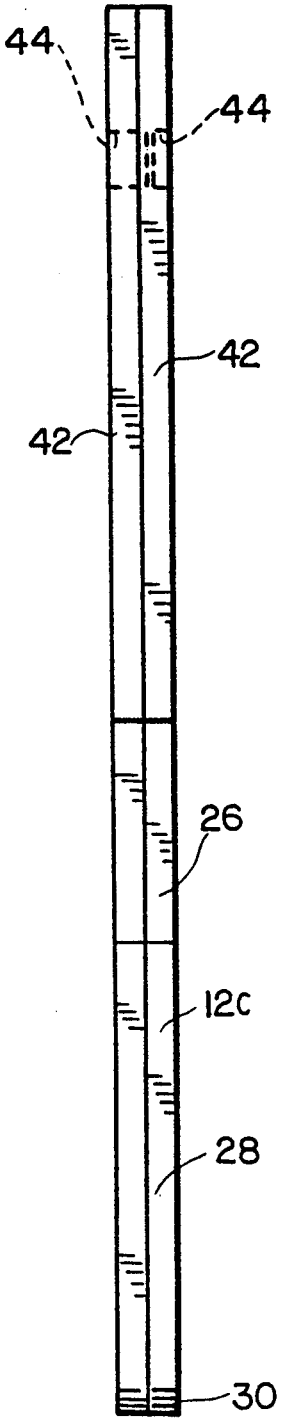
FIG. 8 is a side view of a comb formed with two blanks as shown in FIG. 7.
Figure 9:
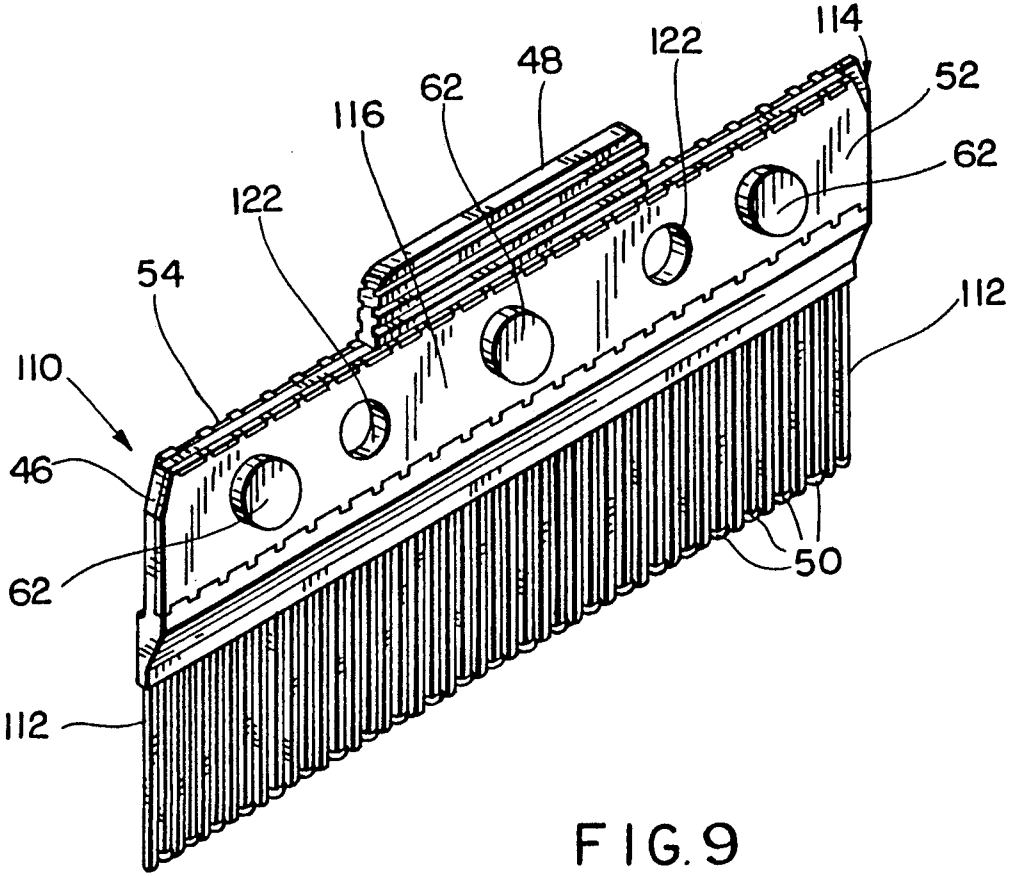
FIG. 9 is a perspective view of a comb according to a further alternate embodiment of the invention.
Figure 12:
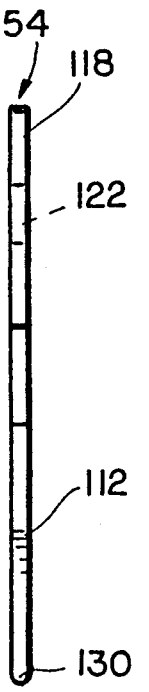
FIG. 12 is a side view of a second half-comb component used to form a comb as in FIG. 9.

In the embodiment of FIG. 7, the final assembly of the comb 10 is accomplished in a different manner than in the comb 10 of FIGS. 1 and 3. Two blanks 42 are put in overlying engagement with the teeth 12*c* of one blank 42 interleaved with those of the other, as shown in FIG. 8 in a side view. These blanks 42 preferably include locating holes 44 that will become coaxial when the teeth 12*c* are in proper interleaved position. The two blanks 42 may be identical except for the positioning of the holes 44. Then, any known locking mechanism, such as a staked plastic rivet or a snap-lock clip (not shown) may be used to secure the two blanks together. Additionally, the body portions 14 of the two blanks 42 may be welded or otherwise joined with an adhesive to achieve the same effect. The resulting comb 10 will have teeth 12*c* in a configuration identical to the teeth 12 of the comb 10 in FIGS. 1 and 3. Of course, the teeth 12*c* could also be stamped with the slight S-bend 40 shown in FIG. 6 so that when interleaved, all teeth are in the same plane. The teeth may also be of any tapered or non-tapered shape, as desired.

FIGS. 9-18 show another preferred embodiment of the invention, having some improvements over the embodiments shown and described above. The overall construction of the comb 110 of this embodiment is intended to allow for the connection of the comb 110 to an electrical power source (not shown) such that an electric potential is created between adjacent teeth 112 of the comb 110.

In this embodiment, body portion 114 is shown with teeth 112 extending from it. The two principal half-comb components of the comb 52,54 are separated and electrically insulated from each other by a non-conductive separator and holder 46 between the layers 116,118 of the body portion 114 of the comb 110. The separator 46 has an extension 48 extending in the opposite direction from the teeth 112 for allowing insulated connection of the comb 110 to a handle (not shown) for easy gripping by an operator. Alternatively, extension 48 may be formed as and serve as a handle. It can also be seen in FIGS. 9, 17, and 18 that one set of teeth 112, i.e., all of the teeth 112 connected to one of the two layers 116, 118 of the body portion 114, include insulating tips 50 attached to their distal ends 130. The specific components and construction of this embodiment will be described in further detail below with respect to FIGS. 10 through 18.

Figure 10:
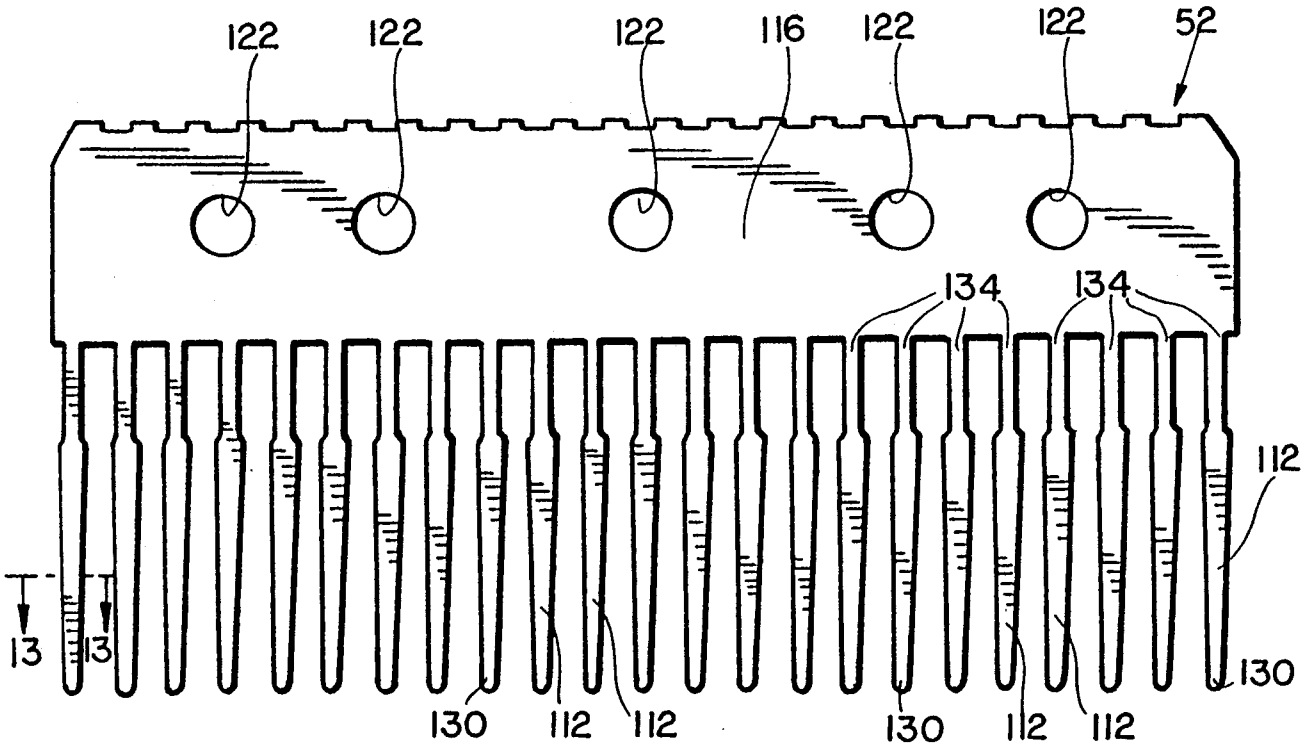
FIG. 10 is a plan view of a first half-comb component used to form a comb as in FIG. 9.

As seen in FIG. 10, the first half-comb component 52 has a body portion layer 116 with a corresponding set of teeth 112 extending from it. In plan view, this first component 52 bears superficial similarity to the blank 42 shown in FIG. 7, in that it is a separate blank for half the comb, not intended to be folded to create the comb as in the embodiment of FIGS. 1 and 3. Indexing holes 122 are provided within the body portion for use in moving the blank for the first component 52 through a progressive stamping machine.

Figure 11:
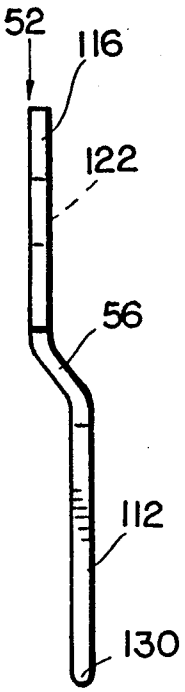
FIG. 11 is a side view of the first half-comb component shown in FIG. 10.

As seen in the side view of the first component 52 in FIG. 11, the teeth 112 have an S-bend 56 near their proximal ends 134 where they join the body portion 114 of the component 52. This S-bend 56 is different from the S-bend 40 shown in FIG. 6 in that it causes the center line of the teeth 112 to be significantly offset from the center line of the body portion 114, preferably by approximately 0.05 inch. The offset is described in more detail below.

Figure 18:
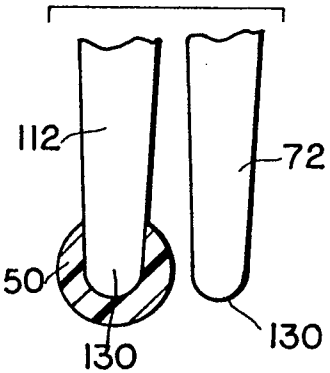
FIG. 18 is a detailed view of the distal end of adjacent teeth in a comb as shown in FIG. 9.
Figure 17:
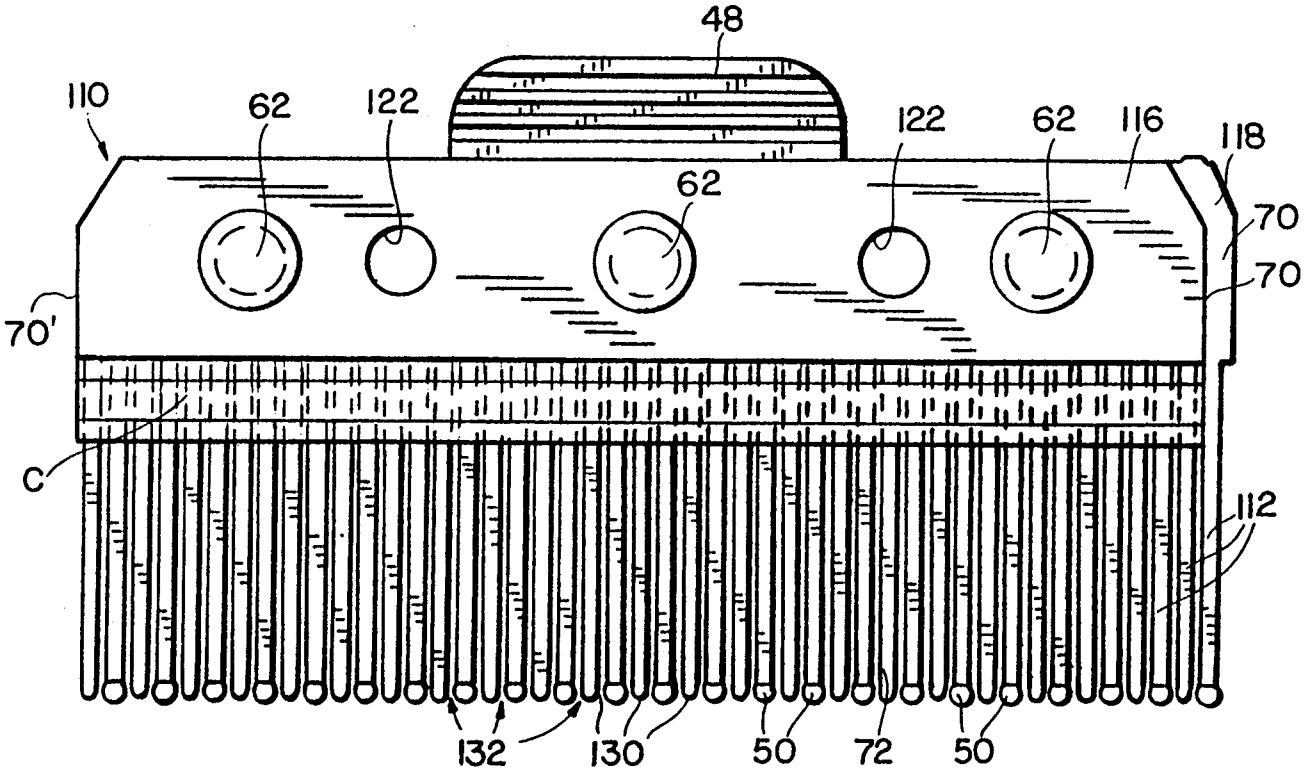
FIG. 17 is a plan view of a completed comb as in FIG. 9.

The second component 54 is similar to that shown in FIG. 10 for the first component 52 except that the teeth 112 of the second component 54 are tipped with insulating tips 50, as seen in FIGS. 17 and 18 and described more fully below. In the second component 54, there is no S-bend in the teeth 112 and the entire component 54 preferably remains flat after stamping, as seen from the side view of the second component 54 in FIG. 12. Each of these components 52,54 is preferably formed by progressive stamping of a long metal strip, and then cut to the lengths desired. Of course, the first and second components 52,54 could be stamped opposite each other from a single continuous strip of stock material and then cut along a median line to create the two components 52,54. Additionally, the first and second components 52,54 are preferably formed from an electrically-conductive material in this embodiment.

Figure 15:
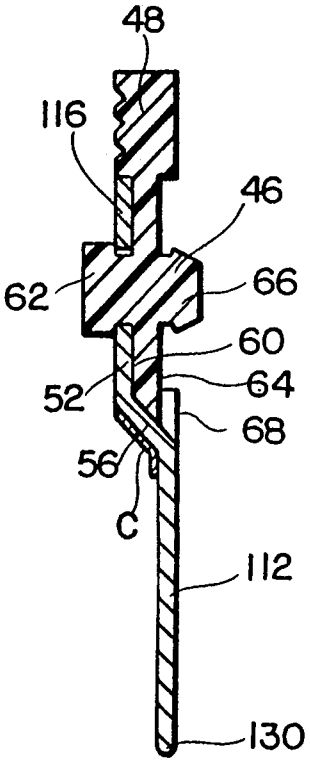
FIG. 15 is a side cross-section view taken along line 15—15 of FIG. 14.
Figure 14:
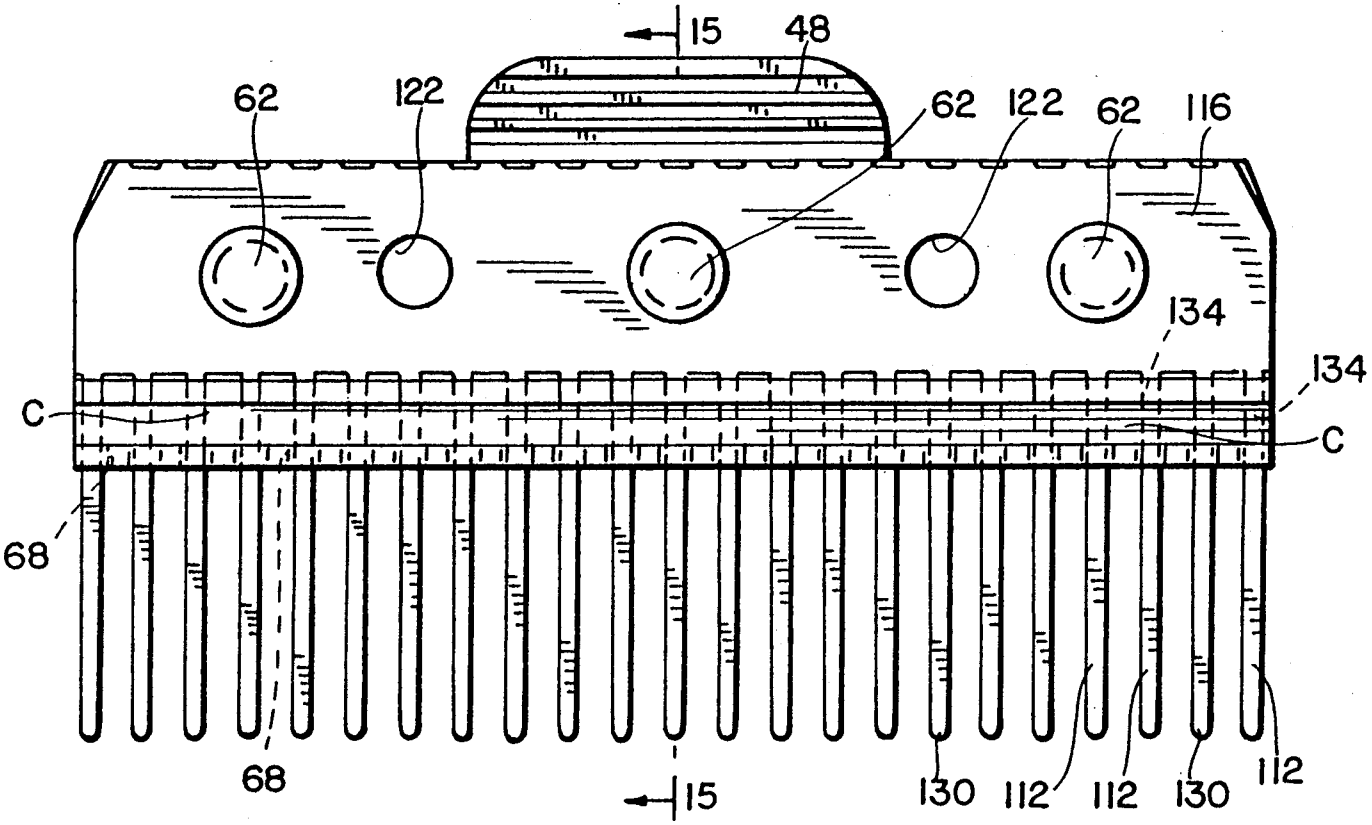
FIG. 14 is a plan view of the first half-comb component blank shown in FIG. 10 mounted onto an electrically insulating separator.
Figure 16:
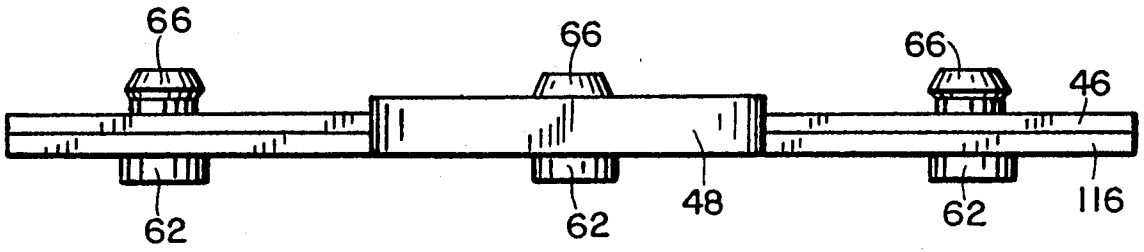
FIG. 16 is a top view of the assembly shown in FIG. 14.

In constructing the comb 110, the insulating separator 46 is assembled onto the first component 52 as shown in FIGS. 14 and 15. It is preferred that the separator 46 be molded directly onto the first component 52, so that the proximal ends 134 of the teeth 112 of the first component 52 are completely surrounded by the separator material at the position marked C (FIGS. 14 and 15). Alternatively, the entire separator 46 could be premolded and then attached to the first half-comb component 52, although the separator 46 would not then be able to surround the teeth 112.

The separator 46 preferably extends over the entire width of the body portion layer 116 and includes a first longitudinal indentation or groove 60 (FIG. 15) matching the surface profile of the body portion of layer 116 of the first component 52. This is readily attained when the separator 46 is directly molded onto the first component 52. Headed protuberances 62 are also preferably molded integral with the separator 46, to retain the first component 52 on the separator 46. These protuberances 62 may engage only some of the holes 122 in the first component 52.

The surface profile of the opposite side of the separator 46 (on the right side as seen in FIG. 15) includes a second longitudinal indentation or groove 64 for receiving the body portion of layer 118 of the second component 54. The second indentation 64 preferably has integral tapered snap-lock buttons 66 extending from its surface for entering corresponding holes 122 in the second component 54, although other connection or adhesive methods may be used. The indentation 64 is preferably formed by molding simultaneously with molding the separator 46 onto the first component 52.

As seen in FIG. 15, the magnitude of the offset produced by the S-bend 56 in the first half-comb component 52 is determined by the thickness of the separator 46. It is preferred that the offset be formed such that teeth 112 connected to the layer 116 will be co-planar with teeth 112 connected to layer 118 when the second half-comb component 54 (FIG. 12) is assembled onto the separator 46, as described in more detail below.

As can be seen most clearly in FIG. 15 at position C, the proximal end, i.e., the S-curved proximal ends 134 of the teeth 112 of the first half-comb component 52 are completely imbedded within the separator 46. The separator 46 also projects outward slightly at position C in the direction of the tapered buttons 66 to form spacers 68 (FIGS. 14 and 15) that are received between the teeth 112 of the second half-comb component 54, defining grooves that receive these teeth 112. These spacers 68 prevent any incidental contact between the proximal ends 134 of adjacent teeth 112 of the comb 110, and thus in use prevent shorting of the electrical system.

The complete assembly of this comb embodiment 110 is shown in FIG. 17. The second half-comb component 54 has been mounted onto the separator 46 by aligning its holes 122 with the tapered buttons 66 and pressing the component 54 into the second indentation 64. After mounting, the buttons 66 may be heat staked to fix the assembly together.

To prevent incidental electrical contact between the distal ends 130 of the comb 110, which could easily take place by tooth deflections during the pressures of combing, each of the teeth 112 extending from the second half-comb component 54 is provided with a tip 50 of insulating material at its distal end 130. This material is preferably some form of polymer material, such as latex, which may be applied by dipping the half-comb component 54 into liquid insulating material and drying it. Of course, the insulating tips 50 could be applied to the teeth 112 of the first half-comb component 52 instead or those of both half-comb components 52,54. Preferably, the tips 50 are applied to the teeth 112 before both of the two half-comb components 52,54 are attached to the separator 46.

Since the teeth 112 preferably are tapered, it will be appreciated that the insulating tips 50 must be of a large enough size such that as two adjacent teeth 112 are brought together laterally in use, the distal end 130 of an adjacent un-tipped tooth 72 will engage the insulating tip 50 before any portion of the tooth lengths contact one another. This configuration is shown in FIG. 18.

As seen in FIG. 17, the two half-comb components 52,54 overlap and are offset from one another at the comb body portion 114. The comb 110 is preferably formed and assembled in such manner so that one side edge 70 of each body portion layer 116, 118 will have an integral tooth 112 nearly flush with that side edge 70. At its other side edge 70', each half-comb body portion layer 116,118 will overlap the last tooth of the other half-comb body portion. This avoids having an exposed sharp corner which may be dangerous to the user of the comb 110 and/or the person on whom the comb 110 is being used.

The electric potential between adjacent teeth may be created by any suitable connected power supply. The voltage applied should be controlled so that arcs will not jump across the gap 132 between adjacent teeth but will be sufficient to cause current to flow through an intervening nit. Additionally, the inter-tooth gap 132 should be controlled such that the gaps 132 do not become too large through manufacturing mismatches. These mismatches may arise during assembly where adjacent teeth 112 may move laterally with respect to each other, creating larger and smaller gaps 132 or individual teeth 112 that are bent in and out of the plane of the comb 110, which would serve to widen the inter-tooth gap 132. If the gap 132 becomes too large, any set electrical potential becomes less effective across that gap 132. If the gap 132 becomes too narrow, it will be difficult to move the comb 110 through hair. With the embodiment of FIGS. 9–18, since electricity is used as well as the physical removal of nits, the inter-tooth gap 132 need not be as narrow as with the other embodiments, making the comb 110 easier to manufacture.

The remaining holes 122 that are not connected to the separator 46 may be used for connection to a handle or connection to an electrical power system.

Figure 13:
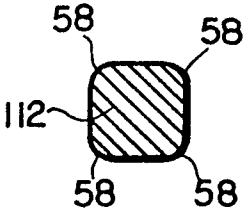
FIG. 13 is a cross section of a tooth taken along lines 13—13 of FIG. 10.

The teeth 112 extending from the body portion 116 are generally similar to those described with respect to other embodiments, and may have any of the various tapered or non-tapered configurations. FIG. 13 shows a preferred cross section of one of the teeth 112. This cross section can be applied to the teeth **12,12*a*,12*b*,12*c*,112 of any of the embodiments shown. As can be seen, it is preferred that the corners 58 of the teeth 112 be rounded to facilitate movement of the hair through the inter-tooth gaps 132 without damaging the hair shafts during the combing process. Of course it is contemplated that any cross sectional shape can be used for the teeth 112, so long as the inter-tooth gaps 132** remain wide enough to allow hair to pass through and narrow enough to engage nits and remove them from the hair shafts.

By way of example, the tooth width may vary from about 0.022 inch near the distal end to about 0.027 inch at its widest portion. The pitch of the teeth of the final comb may be about 0.070 inch. The inter-tooth spacing may taper between about 0.004 inch and about 0.013 inch. The stock material thickness may be about 0.025 inch. The number of teeth and length of the comb may be selected to satisfy individual requirements. In an example, the comb was about 1.6 inches long, with about 44 teeth. The tooth length outside the separator may be about 0.38 inch.

It is thus seen that with the various embodiments of the comb of the present invention, significant advantages are gained over the prior art in terms of reduction in manufacturing components, reduction in manufacturing steps, reduction in manufacturing complexity, and thus a decrease in associated costs.

While the embodiments shown and described are fully capable of achieving the objects of the invention, it is to be understood that these embodiments are shown and described for the purposes of illustration and not for limitation.

What is claimed is:

1. A fine tooth comb for connection to an electric power source, comprising:

a body portion having two body portion sections formed of conductive sheet material, and an insulating separator interposed between and connected to each of said body portion sections, such that said body portion sections being electrically insulated from one another by said insulating separator;

said comb further comprising two sets of teeth, each of said sets extending from a corresponding one of said sections said sets of teeth being interleaved.

2. A comb as in claim 1 wherein the teeth of one of said sets of teeth are bent adjacent their proximal ends such that said sets of teeth will be co-planar.

3. A comb as in claim 1 further comprising insulating tips covering the distal ends of the teeth of one of said sets of teeth.

4. A comb as in claim 1 wherein said teeth of said sets of teeth have tapered width.

5. A comb as in claim 1 wherein said teeth of said sets of teeth have substantially equal widths at their proximal and distal ends.

6. A comb as in claim 1 wherein said separator is molded directly to one of said sections and surrounds the proximal ends of the set of teeth extending from said one of said sections.

7. A comb as in claim 6 wherein said separator further comprises an extension extending beyond said sections in a direction opposite said sets of teeth.

8. A comb as in claim 6 wherein said separator further comprises at least one tapered button, said other of said sections having a hole for receiving and retaining each respective button.

9. A method of forming a fine tooth comb from conductive sheet material for connection to an electrical power supply, comprising the steps of:

forming two half combs, each having a body portion, such that each of said half combs has a set of integral teeth extending from a side of the respective body portion;

positioning said half combs such that said teeth are interleaved;

interposing an insulating separator between said body portions of said half combs, said half combs being electrically insulated from each other by said insulating separator.

10. A method as in claim 9, further comprising the step of:

bending said set of teeth of one of said half-combs adjacent the proximal ends of said teeth such that said sets of teeth will be co-planar when interleaved.

11. A method as in claim 10, further comprising the step of:

molding said insulating separator directly onto said one of said half-combs such that said separator will completely surround its proximal ends of the teeth of said one half-comb.

12. A method as in claim 9, further comprising the step of:

forming insulating tips on the distal ends of the teeth of one of said sets of teeth.

* * * * *